US008678907B2

(12) United States Patent
Pacey

(10) Patent No.: US 8,678,907 B2
(45) Date of Patent: Mar. 25, 2014

(54) WAGERING GAME WITH DYNAMICALLY ADDED SUB-SYMBOLS

(75) Inventor: Larry Pacey, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 578 days.

(21) Appl. No.: 12/513,974

(22) PCT Filed: Nov. 9, 2007

(86) PCT No.: PCT/US2007/023389
§ 371 (c)(1),
(2), (4) Date: May 7, 2009

(87) PCT Pub. No.: WO2008/063408
PCT Pub. Date: May 29, 2008

(65) Prior Publication Data

US 2010/0029369 A1 Feb. 4, 2010

Related U.S. Application Data

(60) Provisional application No. 60/865,362, filed on Nov. 10, 2006.

(51) Int. Cl.
*G07F 17/32* (2006.01)
*A63F 13/10* (2006.01)

(52) U.S. Cl.
USPC ..... 463/20; 463/16; 463/17; 463/22

(58) Field of Classification Search
USPC ..... 463/16–22, 25–27
See application file for complete search history.

(56) References Cited

U.S. PATENT DOCUMENTS

| | | | | |
|---|---|---|---|---|
| 4,695,053 | A * | 9/1987 | Vazquez et al. | 463/18 |
| 5,655,961 | A | 8/1997 | Acres et al. | |
| 5,941,773 | A | 8/1999 | Harlick | |
| 6,135,884 | A | 10/2000 | Hedrick et al. | |
| 6,190,255 | B1 | 2/2001 | Thomas et al. | |
| 6,203,429 | B1 | 3/2001 | Demar et al. | |
| 6,234,897 | B1 | 5/2001 | Frohm et al. | |
| 6,375,570 | B1 | 4/2002 | Poole | |
| 6,443,837 | B1 | 9/2002 | Jaffe et al. | |

(Continued)

FOREIGN PATENT DOCUMENTS

| | | |
|---|---|---|
| AU | 2005251830 B2 | 12/2005 |
| AU | 2007319923 | 5/2012 |

(Continued)

OTHER PUBLICATIONS

"U.S. Appl. No. 12/513,994, Non Final Office Action mailed Dec. 10, 2010", 10 pgs.

(Continued)

*Primary Examiner* — Arthur O Hall
*Assistant Examiner* — Bach Hoang
(74) *Attorney, Agent, or Firm* — Nixon Peabody LLP

(57) ABSTRACT

Methods, apparatus and systems for providing a sub-symbol arrangement to a wagering game machine for triggering a bonus game are described. A dynamic calculation module is used for dynamically adding sub-symbols to an arrangement of symbols to match a bonus game frequency. In some embodiments, the sub-symbols are dynamically added to symbols according to a weighted table. Wagering game machines according to the various embodiments of the invention are also disclosed.

49 Claims, 9 Drawing Sheets

(56) References Cited

U.S. PATENT DOCUMENTS

| | | | | |
|---|---|---|---|---|
| RE37,885 | E | 10/2002 | Acres et al. | |
| 6,561,900 | B1 | 5/2003 | Baerlocher et al. | |
| 6,565,436 | B1 * | 5/2003 | Baerlocher | 463/26 |
| 6,648,757 | B1 | 11/2003 | Slomiany et al. | |
| 6,860,810 | B2 | 3/2005 | Cannon et al. | |
| RE38,812 | E | 10/2005 | Acres et al. | |
| 6,960,134 | B2 | 11/2005 | Hartl et al. | |
| 7,131,908 | B2 * | 11/2006 | Baerlocher | 463/20 |
| 7,144,321 | B2 | 12/2006 | Mayeroff | |
| 7,235,011 | B2 | 6/2007 | Randall et al. | |
| 7,278,919 | B2 | 10/2007 | Souza et al. | |
| 7,285,049 | B1 | 10/2007 | Luciano, Jr. et al. | |
| 7,371,171 | B1 * | 5/2008 | Englman et al. | 463/20 |
| 7,445,548 | B1 | 11/2008 | Muskin | |
| 7,513,827 | B2 * | 4/2009 | Baerlocher | 463/20 |
| 7,591,724 | B2 * | 9/2009 | Baerlocher | 463/20 |
| 7,722,453 | B2 | 5/2010 | Lark et al. | |
| 7,771,264 | B2 | 8/2010 | Kane et al. | |
| 7,914,377 | B2 * | 3/2011 | Benbrahim et al. | 463/25 |
| 7,967,675 | B1 | 6/2011 | Delaney et al. | |
| 8,202,158 | B2 | 6/2012 | Anderson et al. | |
| 8,221,228 | B2 * | 7/2012 | Anderson et al. | 463/25 |
| 2001/0011797 | A1 | 8/2001 | Pierce et al. | |
| 2002/0025847 | A1 | 2/2002 | Thomas et al. | |
| 2002/0039919 | A1 | 4/2002 | Joshi et al. | |
| 2002/0090990 | A1 | 7/2002 | Joshi et al. | |
| 2002/0142825 | A1 | 10/2002 | Lark | |
| 2002/0175466 | A1 | 11/2002 | Loose et al. | |
| 2003/0036423 | A1 | 2/2003 | Vancura | |
| 2003/0060266 | A1 * | 3/2003 | Baerlocher | 463/20 |
| 2003/0060281 | A1 | 3/2003 | Vancura | |
| 2003/0114218 | A1 | 6/2003 | McClintic | |
| 2003/0153375 | A1 | 8/2003 | Vancura | |
| 2003/0176215 | A1 | 9/2003 | Palmer et al. | |
| 2003/0176216 | A1 * | 9/2003 | Storey | 463/25 |
| 2003/0176220 | A1 * | 9/2003 | Baerlocher | 463/26 |
| 2004/0048649 | A1 | 3/2004 | Peterson et al. | |
| 2004/0048655 | A1 | 3/2004 | Yoshioka | |
| 2004/0048657 | A1 | 3/2004 | Gauselmann | |
| 2004/0092315 | A1 | 5/2004 | Boyd et al. | |
| 2004/0106446 | A1 | 6/2004 | Cannon et al. | |
| 2004/0147306 | A1 | 7/2004 | Randall et al. | |
| 2004/0166918 | A1 | 8/2004 | Walker | |
| 2004/0185930 | A1 | 9/2004 | Thomas et al. | |
| 2004/0219969 | A1 | 11/2004 | Casey et al. | |
| 2005/0096121 | A1 | 5/2005 | Gilliland et al. | |
| 2005/0159208 | A1 | 7/2005 | Pacey | |
| 2005/0159211 | A1 * | 7/2005 | Englman | 463/25 |
| 2005/0164765 | A1 | 7/2005 | Okuniewicz | |
| 2005/0170877 | A1 | 8/2005 | Okuniewicz | |
| 2005/0187004 | A1 | 8/2005 | Vancura | |
| 2005/0215311 | A1 | 9/2005 | Hornik et al. | |
| 2005/0250568 | A1 | 11/2005 | Kane et al. | |
| 2006/0014582 | A1 | 1/2006 | Harris et al. | |
| 2006/0025200 | A1 | 2/2006 | Van Asdale | |
| 2006/0025201 | A1 * | 2/2006 | Van Asdale | 463/20 |
| 2006/0035707 | A1 | 2/2006 | Nguyen et al. | |
| 2006/0046819 | A1 | 3/2006 | Nguyen et al. | |
| 2006/0073879 | A1 * | 4/2006 | Baerlocher | 463/20 |
| 2006/0073887 | A1 | 4/2006 | Nguyen | |
| 2006/0073888 | A1 | 4/2006 | Nguyen | |
| 2006/0073897 | A1 | 4/2006 | Englman et al. | |
| 2006/0089190 | A1 | 4/2006 | Bryant et al. | |
| 2006/0089195 | A1 | 4/2006 | Walker et al. | |
| 2006/0142079 | A1 | 6/2006 | Ikehara | |
| 2006/0166733 | A1 | 7/2006 | Hettinger | |
| 2007/0015572 | A1 * | 1/2007 | Baerlocher | 463/25 |
| 2007/0060314 | A1 | 3/2007 | Baerlocher et al. | |
| 2007/0060321 | A1 | 3/2007 | Vasquez | |
| 2007/0191088 | A1 | 8/2007 | Breckner et al. | |
| 2007/0218975 | A1 | 9/2007 | Iddings et al. | |
| 2007/0225065 | A1 | 9/2007 | Wright et al. | |
| 2007/0259709 | A1 | 11/2007 | Kelly et al. | |
| 2007/0293293 | A1 | 12/2007 | Baerlocher et al. | |
| 2007/0298857 | A1 | 12/2007 | Schlottmann et al. | |
| 2007/0298874 | A1 | 12/2007 | Baerlocher et al. | |
| 2007/0298875 | A1 | 12/2007 | Baerlocher et al. | |
| 2008/0020830 | A1 | 1/2008 | Ikehara et al. | |
| 2008/0020831 | A1 | 1/2008 | Ikehara et al. | |
| 2008/0020832 | A1 | 1/2008 | Iddings et al. | |
| 2008/0020833 | A1 | 1/2008 | Baerlocher et al. | |
| 2008/0020834 | A1 | 1/2008 | Breckner et al. | |
| 2008/0020846 | A1 | 1/2008 | Vasquez et al. | |
| 2008/0045344 | A1 | 2/2008 | Schlottmann et al. | |
| 2008/0064502 | A1 | 3/2008 | Schlottmann et al. | |
| 2008/0070680 | A1 | 3/2008 | Baerlocher et al. | |
| 2008/0070692 | A1 | 3/2008 | Schlottmann et al. | |
| 2008/0070693 | A1 | 3/2008 | Schlottmann et al. | |
| 2008/0070694 | A1 | 3/2008 | Schlottmann et al. | |
| 2008/0070695 | A1 | 3/2008 | Baerlocher et al. | |
| 2008/0076514 | A1 | 3/2008 | Baerlocher et al. | |
| 2008/0076515 | A1 | 3/2008 | Baerlocher et al. | |
| 2008/0076517 | A1 | 3/2008 | Baerlocher et al. | |
| 2008/0076552 | A1 | 3/2008 | Baerlocher et al. | |
| 2009/0291752 | A1 | 11/2009 | Anderson et al. | |
| 2009/0305776 | A1 | 12/2009 | Englman et al. | |
| 2010/0048283 | A1 | 2/2010 | Anderson et al. | |
| 2010/0048293 | A1 | 2/2010 | Hornik | |
| 2010/0062841 | A1 | 3/2010 | Englman et al. | |

FOREIGN PATENT DOCUMENTS

| | | | |
|---|---|---|---|
| EP | 0945837 | | 9/1999 |
| EP | 1453023 | | 9/2004 |
| WO | WO-03006129 | A1 | 1/2003 |
| WO | WO-03036423 | A1 | 2/2003 |
| WO | WO-2005187004 | A1 | 8/2005 |
| WO | WO-2006076185 | A2 | 7/2006 |
| WO | WO-2008030904 | A2 | 3/2008 |
| WO | WO-2008060426 | A2 | 5/2008 |
| WO | WO-2008060426 | A3 | 5/2008 |
| WO | WO-2008060429 | A2 | 5/2008 |
| WO | WO-2008060429 | A3 | 5/2008 |
| WO | WO-2008060442 | A2 | 5/2008 |
| WO | WO-2008060442 | A3 | 5/2008 |
| WO | WO-2008060442 | C2 | 5/2008 |
| WO | WO-2008060459 | A2 | 5/2008 |
| WO | WO-2008060459 | A3 | 5/2008 |
| WO | WO-2008060513 | A2 | 5/2008 |
| WO | WO-2008060513 | A3 | 5/2008 |

OTHER PUBLICATIONS

"U.S. Appl. No. 12/513,994, Response filed Apr. 11, 2011 to Non Final Office Action mailed Dec. 10, 2001", 10 pgs.

"U.S. Appl. No. 12/514,019, Examiner Interview Summary mailed Apr. 25, 2011", 4 pgs.

"U.S. Appl. No. 12/514,019, Non Final Office Action mailed Jan. 20, 2011", 9 pgs.

"U.S. Appl. No. 12/514,019, Response filed Apr. 2, 2011 to Non Final Office Action mailed Jan. 20, 2011", 12 pgs.

"U.S. Appl. No. 12/514,038, Non Final Office Action mailed Jan. 5, 2011", 10 pgs.

"U.S. Appl. No. 12/514,038, Response filed Apr. 5, 2011 to Non Final Office Action mailed Jan. 5, 2011", 10 pgs.

"U.S. Appl. No. 12/514,421 Non-Final Office Action mailed Oct. 8, 2010", 18 pgs.

"U.S. Appl. No. 12/514,421, Response filed Feb. 8, 2011 to Non Final Office Action mailed Oct. 8, 2011", 11 pgs.

"U.S. Appl. No. 12/514,426, Non Final Office Action mailed Feb. 3, 2011", 11 pgs.

"European Application Serial No. 07861814.7, Extended European Search Report mailed Nov. 26, 2010", 7 pgs.

"European Application Serial No. 07839999.5, Extended European Search Report mailed Apr. 6, 2011", 6 Pgs.

"International Application Serial No. PCT/US2007/023389, International Report on Patentability completed Nov. 16, 2010", 15 pgs.

"International Application Serial No. PCT/US2007/023499, International Report on Patentability, mailed Jul. 24, 2009", 7 pgs.

"International Application Serial No. PCT/US2007/023499, Search Report mailed Jul. 22, 2008", 2 pgs.

(56) References Cited

OTHER PUBLICATIONS

"International Application Serial No. PCT/US2007/023499, Written Opinion mailed Jul. 22, 2008", 7 pgs.
"International Application Serial No. PCT/US2007/023503, International Preliminary Report on Patentability, mailed mailed on Jul. 16, 2009".
"International Application Serial No. PCT/US2007/023503, Search Report mailed on Jul. 23, 2008", 2 pgs.
"International Application Serial No. PCT/US2007/023503, Written Opinion mailed on Jul. 23, 2008", 5 pgs.
"International Application Serial No. PCT/US2007/023572, International Preliminary Report on Patentability, mailed Jun. 18, 2009", 14 pgs.
"International Application Serial No. PCT/US2007/023572, International Search Report mailed May 9, 2008", 2 pgs.
"International Application Serial No. PCT/US2007/023572, International Written Opinion mailed May 9, 2008", 7 pgs.
"International Application Serial No. PCT/US2007/023636, International Report on Patentability mailed Jun. 18, 2009", 10 pgs.
"International Application Serial No. PCT/US2007/023636, Search Report mailed Jun. 23, 2008", 2 pgs.
"International Application Serial No. PCT/US2007/023636, Written Opinion mailed Jun. 23, 2008", 7 pgs.
"International Application Serial No. PCT/US2007/023753 Search Report mailed Jun. 23, 2008", 4 pgs.
"International Application Serial No. PCT/US2007/023753 Written Opinion mailed Jun. 23, 2008", 8 pgs.
"International Application Serial No. PCT/US2007/023753, International Report on Patentability mailed Jun. 18, 2009", 11 pgs.
"U.S. Appl. No. 12/513,994, Final Office Action mailed Jul. 21, 2011", 14 pgs.
"U.S. Appl. No. 12/514,019, Final Office Action mailed Jul. 21, 2011", 15 pgs.
"U.S. Appl. No. 12/514,038, Examiner Interview Summary Received Apr. 6, 2011", 3 pgs.
"U.S. Appl. No. 12/514,038, Final Office Action mailed Jun. 24, 2011", 11 pgs.
"U.S. Appl. No. 12/514,038, Non Final Office Action mailed Sep. 13, 2011", 12 pgs.
"U.S. Appl. No. 12/514,038, Response filed Aug. 24, 2011 to Final Office Action mailed Jun. 24, 2011", 12 pgs.
"U.S. Appl. No. 12/514,421, Final Office Action mailed Jun. 2, 2011", 17 pgs.
"U.S. Appl. No. 12/514,426, Final Office Action mailed Sep. 12, 2011", 14 pgs.
"U.S. Appl. No. 12/514,426, Response filed May 23, 2011 to Non Final Office Action mailed Feb. 3, 2011", 10 pgs.
"U.S. Appl. No. 12/513,994, Examiner Interview Summary mailed Mar. 22, 2011", 3 pgs.
"U.S. Appl. No. 12/513,994, Examiner Interview Summary mailed Oct. 3, 2011", 3 pgs.
"U.S. Appl. No. 12/513,994, Preliminary Amendment filed May 7, 2009", 7 pgs.
"U.S. Appl. No. 12/513,994, Response filed Nov. 21, 2011 to Final Office Action mailed Jul. 21, 2011", 13 pgs.
"U.S. Appl. No. 12/514,019, Appeal Brief filed Jan. 17, 2012", 33 pgs.
"U.S. Appl. No. 12/514,019, Examiner's Answer to Appeal Brief mailed Jun. 6, 2012", 18 pgs.
"U.S. Appl. No. 12/514,019, Reply Brief filed Jul. 18, 2012", 9 pgs.
"U.S. Appl. No. 12/514,038, Advisory Action mailed Jun. 28, 2012", 3 pgs.
"U.S. Appl. No. 12/514,038, Examiner Interview Summary mailed Aug. 31, 2011", 3 pgs.
"U.S. Appl. No. 12/514,038, Examiner Interview Summary mailed Dec. 13, 2011", 3 pgs.
"U.S. Appl. No. 12/514,038, Final Office Action mailed Apr. 16, 2012", 10 pgs.
"U.S. Appl. No. 12/514,038, Preliminary Amendment filed May 7, 2009", 13 pgs.
"U.S. Appl. No. 12/514,038, Response filed Jun. 18, 2012 to Final Office Action mailed Apr. 16, 2012", 11 pgs.
"U.S. Appl. No. 12/514,038, Response filed Jul. 16, 2012 to Final Office Action mailed Apr. 16, 2012", 13 pgs.
"U.S. Appl. No. 12/514,038, Response filed Dec. 13, 2011 to Non Final Office Action mailed Sep. 13, 2011", 14 pgs.
"U.S. Appl. No. 12/514,421, Response filed Sep. 30, 2011 to Final Office Action mailed Jun. 2, 2011", 16 pgs.
"U.S. Appl. No. 12/514,426, 312 Amendment filed May 14, 2012", 8 pgs.
"U.S. Appl. No. 12/514,426, Examiner Interview Summary mailed May 24, 2011", 4 pgs.
"U.S. Appl. No. 12/514,426, Notice of Allowance mailed Feb. 14, 2012", 12 pgs.
"U.S. Appl. No. 12/514,426, Preliminary Amendment filed May 11, 2009", 7 pgs.
"U.S. Appl. No. 12/514,426, PTO Response to 312 Amendment mailed May 24, 2012", 2 pgs.
"U.S. Appl. No. 12/514,426, Response filed Dec. 22, 2011 to Final Office Action mailed Sep. 12, 2011", 16 pgs.
"Australian Application Serial No. 2007319884, Examiner Report Mailed Dec. 9, 2011", 2 pgs.
"Australian Application Serial No. 2007319923—Office Action Response", 17 pgs.
"Australian Application Serial No. 2007319923, Examiner Report mailed Dec. 19, 2011", 2 pgs.
"Australian Application Serial No. 2007319923, Response filed Mar. 7, 2012 to Examiner Report mailed Dec. 19, 2011", 5 pgs.
"Australian Application Serial No. 2007319923, Second Examiners Report mailed Apr. 12, 2012", 2 pgs.
"Australian Application Serial No. 2007319986, Examiners Report mailed Dec. 7, 2011", 2 pgs.
"Australian Application Serial No. 2007319986, Response filed Aug. 3, 2012 to Examiner's Report mailed Dec. 7, 2011", 20 pgs.
"Australian Application Serial No. 2007319989, Office Action mailed Jan. 13, 2012", 2 pgs.
"Australian Application Serial No. 2007319989, Response filed Aug. 3, 2012 to Examiner's Report mailed Jan. 13, 2012", 20 pgs.
"Australian Application Serial No. 2007320002, Examiner Report mailed Aug. 7, 2012", 3 pgs.
"Australian Application Serial No. 2007320002, Examiner Report mailed Dec. 7, 2011", 2 pgs.
"Australian Application Serial No. 2007320002, Response filed Aug. 3, 2012 to Examiner Report mailed Dec. 7, 2011", 16 pgs.
"Australian Application Serial No. 2007319884, Examiner Report Mailed Nov. 1, 2012", 3 pgs.
"Australian Application Serial No. 2007320002, Response filed Jan. 7, 2013 to Office Action mailed Aug. 7, 2012", 13 pgs.
"Australian Patent Application No. 2007319884, Response to First Office Action Oct. 31, 2012", 3 pgs.

* cited by examiner

WAGERING GAME WITH DYNAMICALLY ADDED SUB-SYMBOLS

RELATED APPLICATION

This patent application is a U.S. National Stage Filing under 35 U.S.C. 371 from International Patent Application Serial No. PCT/US2007/023389 filed Nov. 9, 2007, and published on May 29 2008 as WO 2008/063408 A2 and republished as WO 2008/063408 A3, which claims the priority benefit of U.S. Provisional Patent Application Ser. No. 60/865,362 filed Nov. 10, 2006 and entitled "WAGERING GAME WITH DYNAMICALLY ADDED SUB-SYMBOLS", which applications are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wagering game systems.

BACKGROUND

Wagering game machine makers continually provide new and entertaining games. To keep a player entertained in repetitive wagering gaming content, a computerized wagering game may rely on the presentation of the game. One way of increasing entertainment value is to offer a variety of base wagering games and bonus wagering events. Consequently, there is a need to provide for seamless integration of bonus wager games with base wagering games to ensure an attractive gaming experience.

BRIEF DESCRIPTION OF THE FIGURES

Embodiments of the invention are illustrated by way of example and not limitation in the figures of the accompanying drawings in which.

DESCRIPTION OF THE EMBODIMENTS

Example Operating Environment

Example Wagering Game Machine Architecture

Different bonus games can have different expected values, which can mean that interchanging bonus games with the base wagering game can cause the payout of a base wagering game to change to maintain the expected value of the wagering game. Changing the wager payouts can confuse the player and detract from the pleasure of gaming. A dynamic calculation module can be used to generate relationships between random events to adjust one or more payout frequencies of one or more bonus games selected by the player or the wagering game operator. The dynamic calculation module described herein can be configured to allow any base wagering game to operate with any bonus game.

Figure 1:
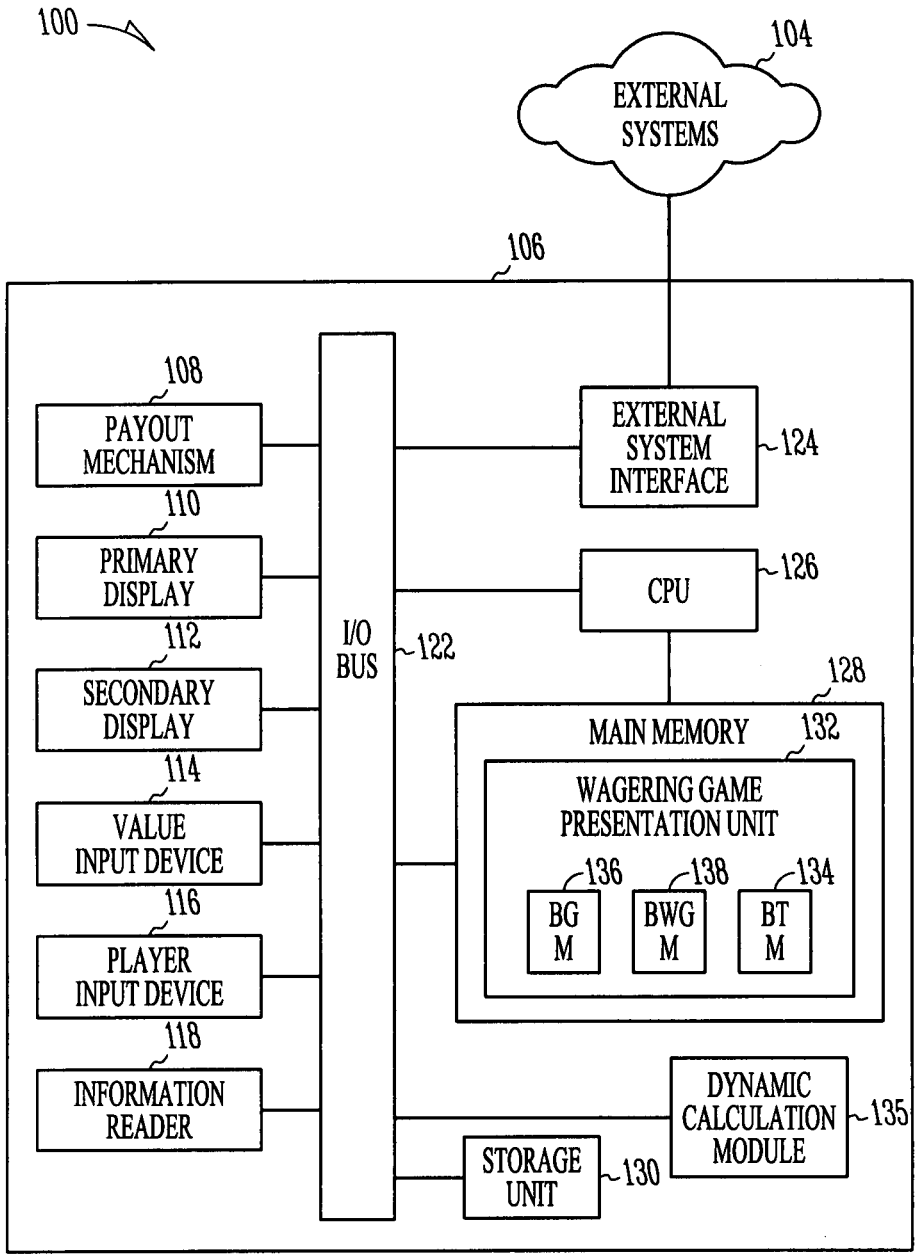
FIG. 1 is a block diagram illustrating a wagering game machine architecture according to example embodiments of the invention.

FIG. 1 is a block diagram illustrating a wagering game machine architecture 100, according to example embodiments of the invention. As shown in FIG. 1, the wagering game machine 106 includes a central processing unit (CPU) 126 connected to main memory 128, which includes a wagering game presentation unit 132. In one embodiment, the wagering game presentation unit 132 can present wagering games, such as video poker, video blackjack, video slots, video lottery, role playing games with wagering content etc., in whole or part. The wagering game presentation unit 132 can include a bonus game module 136 and a base wagering game module 138. The bonus game module 136 and the base wagering game module 138 can be further formed in a portion of the main memory 128 separate from the wagering game presentation unit 132, in a memory in a wagering game machine 106 separate from the main memory 128, or as one or more modules separate from the wagering game machine 106. The bonus game module 136 includes data for generating outcomes of the bonus game, such as bonus game payout frequencies, a bonus game payout value, and an expected values of bonus game wagers. The base wagering game module 138 includes data for generating outcomes of a base wagering game, such as base wagering game payout frequencies, base wagering game payout values, and the expected value of base wagering game wagers. In one embodiment, the bonus game module 136 and the base game module 138 are located outside the wagering game machine 106 coupled to a network device, such as a network server.

The wagering game presentation unit 132 can include a dynamic calculation module 134. In one embodiment, the dynamic calculation module 134 is formed in a portion of the main memory 128 as a unit separate from the wagering game presentation unit 132. In another embodiment, the dynamic calculation module 134 is formed in a memory unit in a wagering game machine 106 separate from the main memory 128. In another embodiment, the dynamic calculation module 134 is formed in a memory unit or as one or more modules separate from the wagering game machine 106. Examples of a dynamic calculation module that can be formed in a memory unit include subroutine code, code libraries and application program interfaces such as interpreters utilizing Java EE™, Simple DirectMedia Layer™ (SDL) and DirectX™. A dynamic calculation module 135 can also be formed as a unit separate from the main memory 128. Examples of a dynamic calculation module 135 include microprocessors, application specific integrated circuits, application specific standard products, field programmable gate arrays, complex programmable logic devices, programmable read only memories, electrically erasable programmable read only memories and other programmable logic devices. The dynamic calculation module 135 can further include subroutine code, code libraries and application program interfaces such as interpreters utilizing Java EE™, Simple DirectMedia Layer™ (SDL) and DirectX™. In one embodiment, the dynamic calculation module 135 includes the dynamic calculation module 134 as a subcomponent. In another embodiment, the dynamic calculation module 135 includes a coprocessor and a memory unit. In another embodiment, the dynamic calculation module 135 includes a signal processor such as a digital signal processor to process sound. In another embodiment, the base wagering game 106 includes the bonus triggering module 134 operatively coupled to a bonus triggering module 135 using an input/output (I/O) bus 122.

The dynamic calculation module 134/135 can receive data from a bonus game module 136 and a base wagering game module 138 and use the received data to generate relationships between symbols and sub-symbols to trigger a bonus game. Sub-symbols are secondary symbols used in association with the primary symbols presented on a display. Primary symbols are a first set of symbols associated with a reel strip of a base wagering game. The primary symbols can be presented on a display as a linear array of symbols, a two-dimensional arrangement of symbols, or as an arrangement of symbols not associated with a particular geometry of a display. The dynamic calculation module 134/135 can dynamically build the relationships between the symbols and sub-symbols during play. In one embodiment, the dynamic calculation module 134/135 uses relationships between the symbols and the sub-symbols stored in a memory unit. Here, the dynamic calculation module can select the relationships between the symbols and sub-symbols that were generated prior to play based on a base wagering game and a selection of one or more bonus games.

The CPU 126 is also connected to I/O bus 122, which facilitates communication between the wagering game machine's components. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include multiple external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 (e.g., the wagering game presentation unit 132) can include hardware, firmware, and/or software for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Dynamic Calculation Module

Figure 2A:
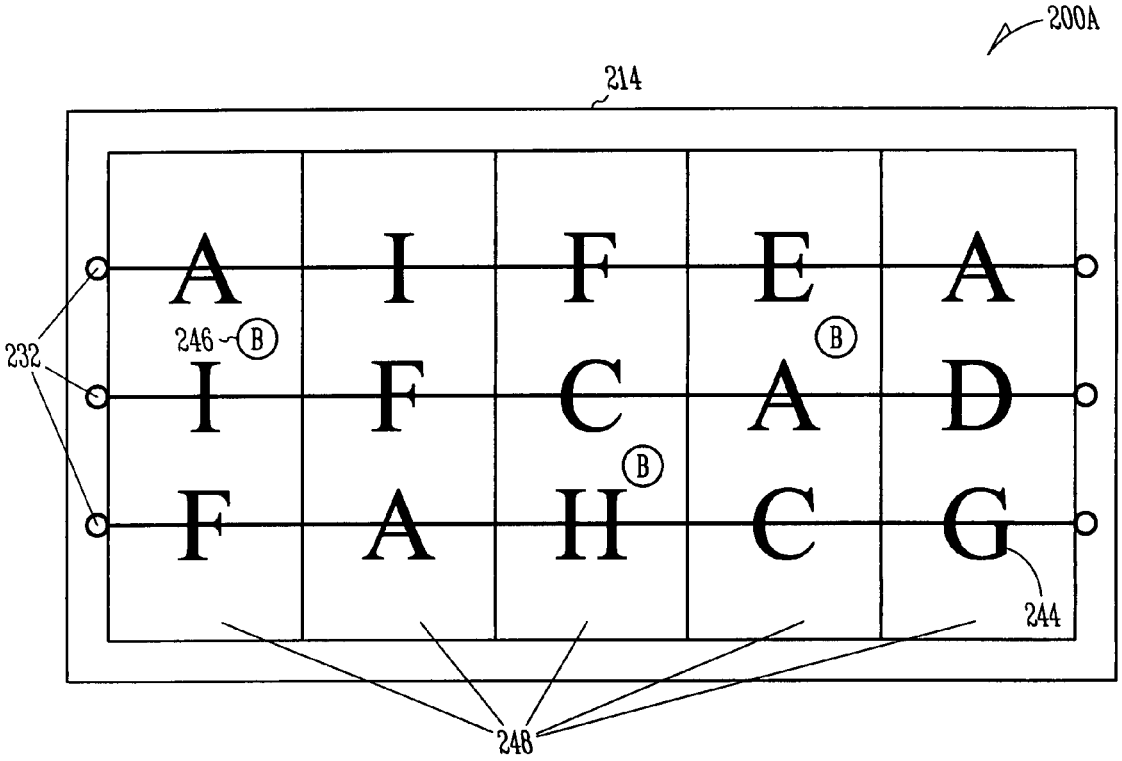
FIG. 2A-B is an example display of a wagering game machine according to example embodiments of the invention.

FIG. 2A is an example display of a wagering game machine 200A, according to example embodiments of the invention. The primary display 214 is shown here with five reels 248 presenting an array of letters 244 arbitrarily representing symbols positioned across pay lines 232. The pay lines 232 are not restricted to the horizontal sequence shown. For example, the pay lines 232 can be a horizontal zigzag line arrangement formed across the primary display 214. Sub-symbols 246 are positioned on the reels 248 as secondary symbols in connection with the letters/symbols 244 according to the mathematical relationships generated by a dynamic calculation module (shown as 134/135 in FIG. 1). The arrangement of the sub-symbols appearing on the primary display 214 can be used to trigger a bonus game as described herein.

The dynamic calculation module 134/135 can accept a range of data from one or more bonus game modules 136, including a plurality of bonus game frequencies and a plurality of bonus game payout values. The expected value of a wagering game can be expressed as $$EV = \sum_{all\ x} (\text{freqency}(x) \times \text{Pay}(x)) / W$$

where W is the value of the wager, frequency(x) is the frequency of occurrence of a symbol arrangement x, and Pay(x) is the payout value assigned to that symbol arrangement. In an embodiment, the wager requirement does not change and the expected value of the wager may be expressed as $$EV = EV_{BWG} + EV_{Bonus},$$

where $EV_{BWG}$ and $EV_{Bonus}$ are the expected values of the base wagering game and the bonus game, respectively.

Figure 2B:
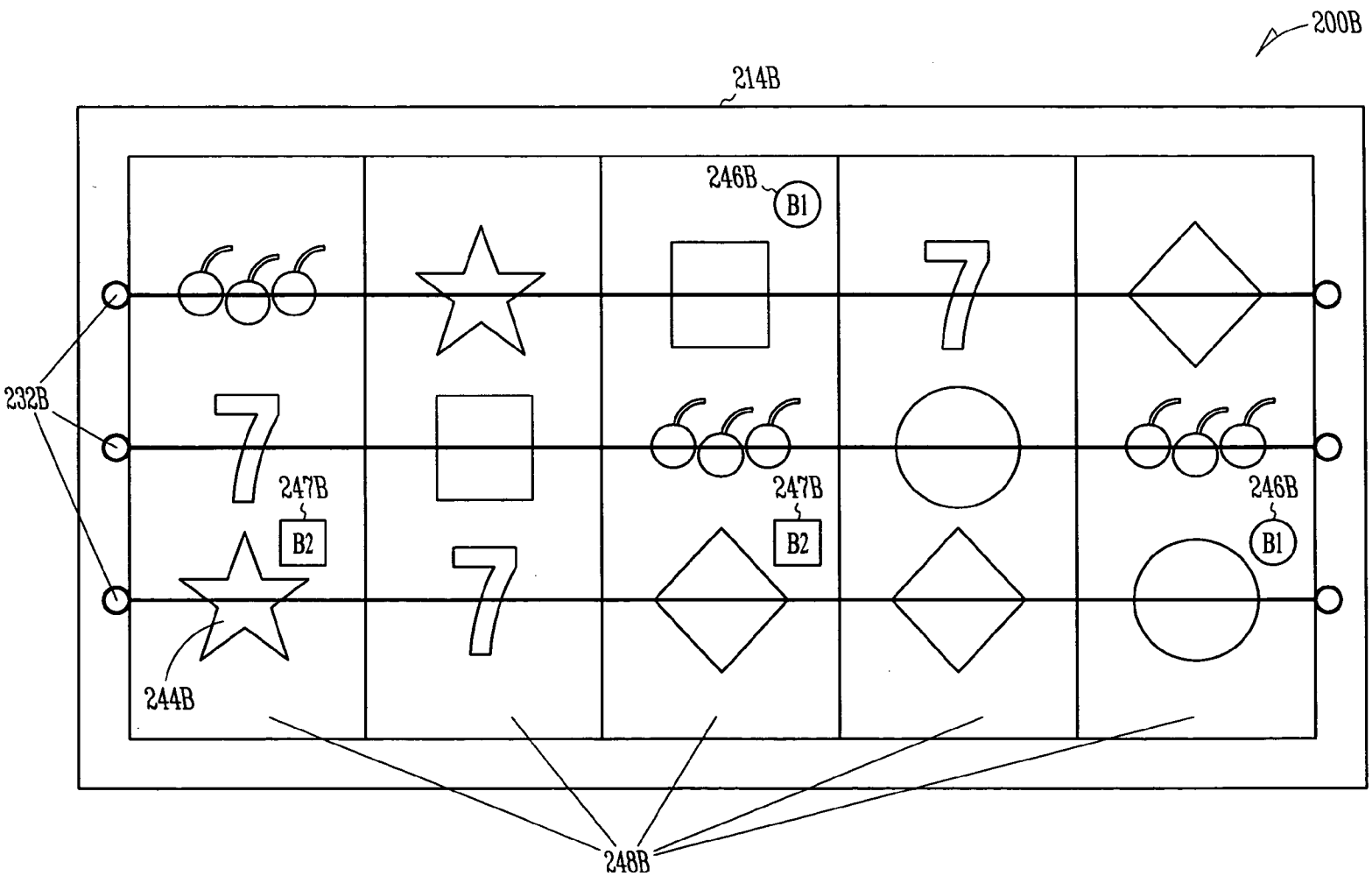

FIG. 2B is an example display of a wagering game machine 200B according to example embodiments of the invention. The primary display 214B is shown here with five reels 248B presenting an array symbols 244B positioned across pay lines 232B. A bonus game can be triggered by generating an occurrence of first-type sub-symbols 246B in association with the symbols 244B on the visible portions of the reels 248B matching a pre-assigned bonus game payout frequency. For example, if a first bonus game has a desired frequency of 1 bonus in 125 games, and the first bonus game has an average payout of 25 times the value of the wager (i.e., a payout ratio of 25:1), the expected value of the bonus game is 25×(1/125) =20%. For a wagering game machine displaying 3 symbols 246B on each of five reels 248B (as shown in display 214), with each reel strip having a length of 60 symbol positions, the first bonus game can be triggered whenever 3 first-type sub-symbols 246B appear anywhere on the 5×3 array. The desired probability of (1/5)×(1/5)×(1/5)=1/125 can be obtained, for example, by placing 4 first-type sub-symbols 246B randomly on each of the 3 reels 248B since the probability that a first-type sub-symbol will be visible on one reel the display 214B is (3×4)/60=1/5.

A second bonus game can be added to the same base wagering game. The second bonus game can be triggered using the same display 214B by generating an occurrence of second-type sub-symbols 247B in association with the symbols 244B on the visible portions of the reels 248B for matching the second pre-assigned bonus game payout frequency. For example, if the second bonus game has a desired frequency of 1 bonus in 250 games, and the second bonus game has an average payout of 50 times the value of the wager (i.e., a payout ratio of 50:1), the expected value of the second bonus game is 50×(1/250)=20%. The second bonus game can be triggered whenever 3 second-type sub-symbols 247B appear anywhere on the 5×3 array. The desired probability of (1/10)(1/5)(1/5)=1/250 can be obtained, for example, by placing 2 second-type sub-symbols 247B randomly on one reel and 4 second-type bonus symbols 247B randomly on reels 2 and 3 since the probability that the second-type sub-symbol 247B will be visible on all reels 248B of the display 214B is $((3\times 2)/60)\times((3\times 4)/60)^2=1/250$. Here, the first-type and the second-type sub-symbols are selected to be different types to avoid triggering a bonus game at a frequency less than the desired bonus game payout frequencies.

Other bonus games can be added by selecting the appropriate combinations of bonus symbols-types on one or more reels. The above examples describe a scatter trigger wagering game, but a line triggered wagering game can be used to further adjust the bonus game payout frequency. In further embodiments, the average payout can be adjusted alone or in combination with the bonus game frequency to obtain the expected values of bonus games. A scatter trigger is an arrangement of sub-symbols that is not correlated with the pay lines 232B. The above examples are not to be taken in the limiting sense, as it will be recognized by one of ordinary skill in the art that any pre-determined bonus game frequency can be matched using further combinations of the number of reels, the length of the reel strips, the number of sub-symbols per reel strip, the pay line requirements, and the size of the visible portion of the display 214B.

The modules for a plurality of different base wagering games can be coupled to one or more dynamic calculation modules that are coupled to a bonus game module to allow a plurality of wagering game machines to play the same bonus game. Here, the dynamic calculation module 134/135 can dynamically add sub-symbols to the individual reel strips of each wagering game in the manner described above to match the payout frequency of the bonus game. In the bonus game trigger example described above, the sub-symbols 246 are not tied to the letters/symbols 244 to scatter trigger a specified bonus game. The dynamic calculation module 134/135 can also arrange the sub-symbols 246 along one or more pay lines 232 to trigger a specified bonus game. In one embodiment, the sub-symbols 246 are associated with one type of letter/symbol, for example, only the letter H. In some embodiments, the sub-symbols 246 are associated with different letters/symbols 244, for example, only the letters 1, H and A. The frequency and position in which the sub-symbols 244 appear in connection with specified letters/symbols 244 is determined by the dynamic calculation module 134/135. In another embodiment, the sub-symbols 246 can be appear without being connected to particular letters/symbols 244.

The sub-symbols 246 can appear on the primary display 214 having a smaller size than the letters/symbols 244 or as having a larger size than the letters/symbols 244. In one embodiment, the sub-symbols 246 are illuminated flashing sub-symbols. In another embodiment, the sub-symbols 246 irregularly modulate in size and/or shape when presented on the primary display 214 to attract the attention of a player. In another embodiment, the sub-symbols 246 oscillate in size and/or shape when displayed. In another embodiment, the sub-symbols 246 can rotate and counter rotate with a specified angle and periodicity. In another embodiment, the sub-symbols 246 can be presented as single-channel or multi-channel holographic images. In another embodiment, the sub-symbols 246 are displayed to a player as dynamically moving holographic images.

The dynamic calculation module 134/135 can be configured to calculate sub-symbol weightings. Weighted values can be used to adjust the relative frequency of sub-symbol occurrences. The weighted sub-symbols 246 can be dynamically added to the display 214 by the dynamic calculation module 134/135 to match the payout frequency of the specified bonus game for each base wagering game. In one embodiment, the dynamic calculation module 134/135 calculates new sub-symbols weighting for each wager played. The sub-symbols 246 can also be arranged in association with the letters/symbols 244 using a weighted table stored in a memory unit. The memory unit may include a plurality of templates for correlating bonus games and base wagering games. In one embodiment, the values selected from the weighted table change for each wager entered.

The memory unit containing the weighted table can be included in the main memory 128 of a wagering game 106, in a different memory unit located in the wagering game 106, or in a memory unit located separate from the wagering game machine 106. In one embodiment, the sub-symbols 246 are displayed in a color corresponding to a specified bonus game. In another embodiment, the sub-symbols 246 change colors. In another embodiment, the sub-symbols 246 are icons matching the icons of the specified bonus games. In another embodiment, the sub-symbols 246 are displayed in connection with a sound corresponding to a bonus game sound, such as a theme sound. In another embodiment, the sub-symbols are displayed in connection with a voice announcing the identity of the bonus wagering games displayed.

The dynamic calculation module 134/135 can be configured to arrange the sub-symbols 246 on the display 214 to match a payout frequency based on any number of bonus wagering games pre-selected by a player. The dynamic calculation module 134/135 can also be configured to arrange the sub-symbols 246 on the display 214 to match a payout frequency based of bonus games pre-selected by the wagering game operator. In one embodiment, the player is able to change the pre-selected bonus games between wagers. In another embodiment, the player is able to add or subtract desired bonus games between wagers. Although the examples above describe sub-symbols 246 associated with an array of letters/symbols 244 arranged on reels 248, this is not to be taken in the limiting sense. Other configurations are possible, including video reels and images presented in any number of graphic formats and themes.

Figure 3:
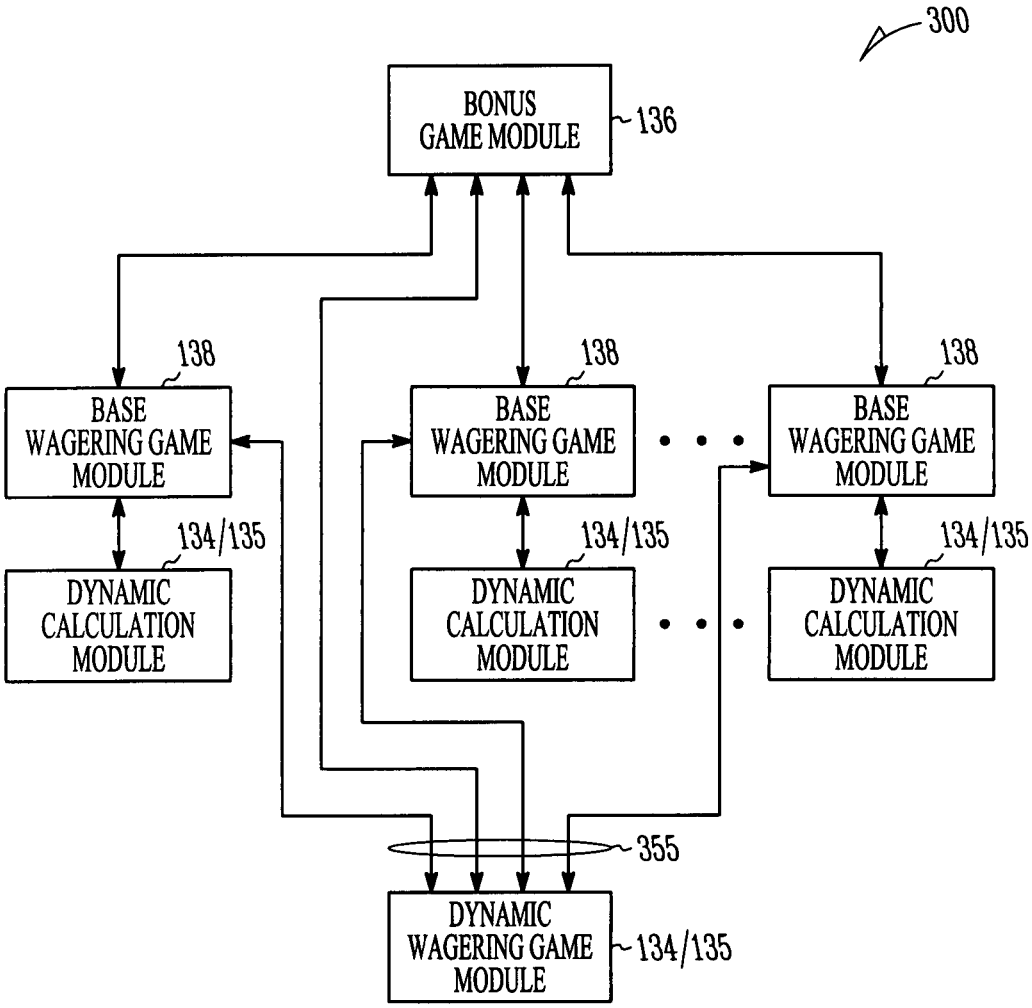
FIG. 3 is a block diagram illustrating a wagering game architecture according to example embodiments of the invention.

FIG. 3 is a block diagram illustrating wagering game architecture 300 according to example embodiments of the invention. Here, the dynamic calculation modules 134/135 are operatively coupled to the base wagering modules 138. For clarity, a single bonus game module 136 is shown operatively coupled to a plurality of base wagering game modules 138. However, the wagering game architecture 300 can include a plurality of bonus game modules, each presenting a different bonus game. The dynamic calculation modules 134/135 can also be operatively coupled to the bonus game module 136 and the base wagering modules 138 using a transmission medium 355 such as a communications network. In one embodiment, the dynamic calculation modules 135/135 form a portion of the base wagering modules 138. In another embodiment, the dynamic calculation modules 134/135 are operatively coupled directly to the bonus game module 136.

Each of the base wagering game modules 138 can be configured to perform a different wagering game. In some embodiments, the base wagering game modules 138 are associated with different wagering game machines (not shown). The dynamic calculation modules 135/135 can be configured to receive data from a bonus game module 136 related to a specified bonus game, such as payout frequencies, payout values and one or more expected values of a wager. The base wagering game modules 138 can be configured to receive data from the dynamic calculation modules 135/135 and to provide data to the dynamic calculation modules 135/135, such as one or more base wagering game payout frequencies, one or more payout values and one or more expected values. In various embodiments, each of the base wagering games 138 triggers the bonus game 136 with the same bonus game frequency.

Example Operations

Figure 4:
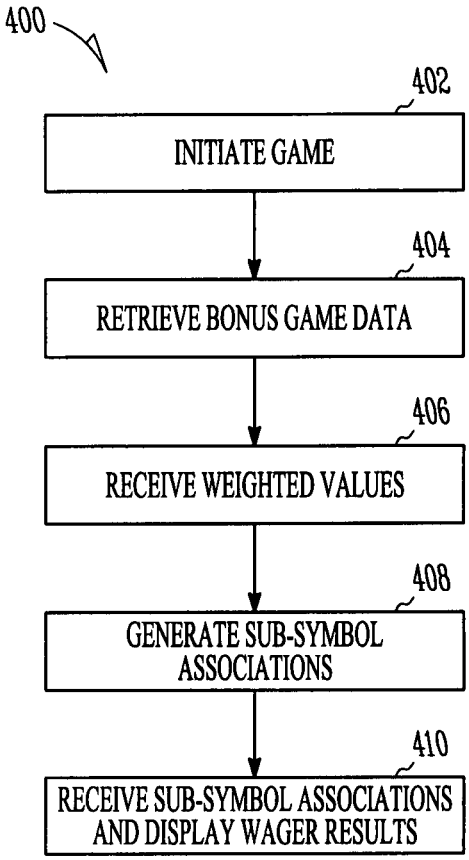
FIG. 4 is a flowchart illustrating a method for operating one or more wagering game machines according to embodiments of the invention.

FIG. 4 is a flowchart illustrating a method 400 for configuring a wagering game machine according to embodiments of the invention. The method begins at block 402 by receiving a wager indicating a base wagering game is to begin. A signal can be transmitted to some or all bonus wagering game modules in a casino, depending on the selection of the player or the wagering game operator. The bonus game module may be located in a wagering game machine, a network server, or a memory location associated with a database in the casino. In one embodiment, the bonus game module is located outside the casino coupled to a network.

At block 404 the bonus game data is received by the dynamic calculation module from the bonus game modules. The received bonus game data include expected values, payout values and bonus game payout frequencies. The received bonus game data can be stored in the dynamic calculation module or a memory associated with the base wagering game. The bonus game data can also be provided from a database over a network medium. In one embodiment, the bonus game modules may pass the bonus game data between bonus game modules. In another embodiment, the bonus game modules pass the bonus game data between the base wagering game modules.

At block 406 the dynamic calculation module may receive weighted values. The weighted values can be stored in the dynamic calculation module or in a memory associated with the base wagering game. In some embodiment, the dynamic calculation module determines whether to use some or all of the weighted values, or to discard the weighted values. In one embodiment, discarding the weighted value adjusts the sub-symbol weightings to one.

At block 408 the dynamic calculation module calculates the payout frequencies of the bonus games and generates the corresponding sub-symbol associations for presentation on a display associated with a base wagering game.

At block 410 the sub-symbol associations are received by the wagering game machine and the results of the wager are presented to the player on a display.

Figure 5:
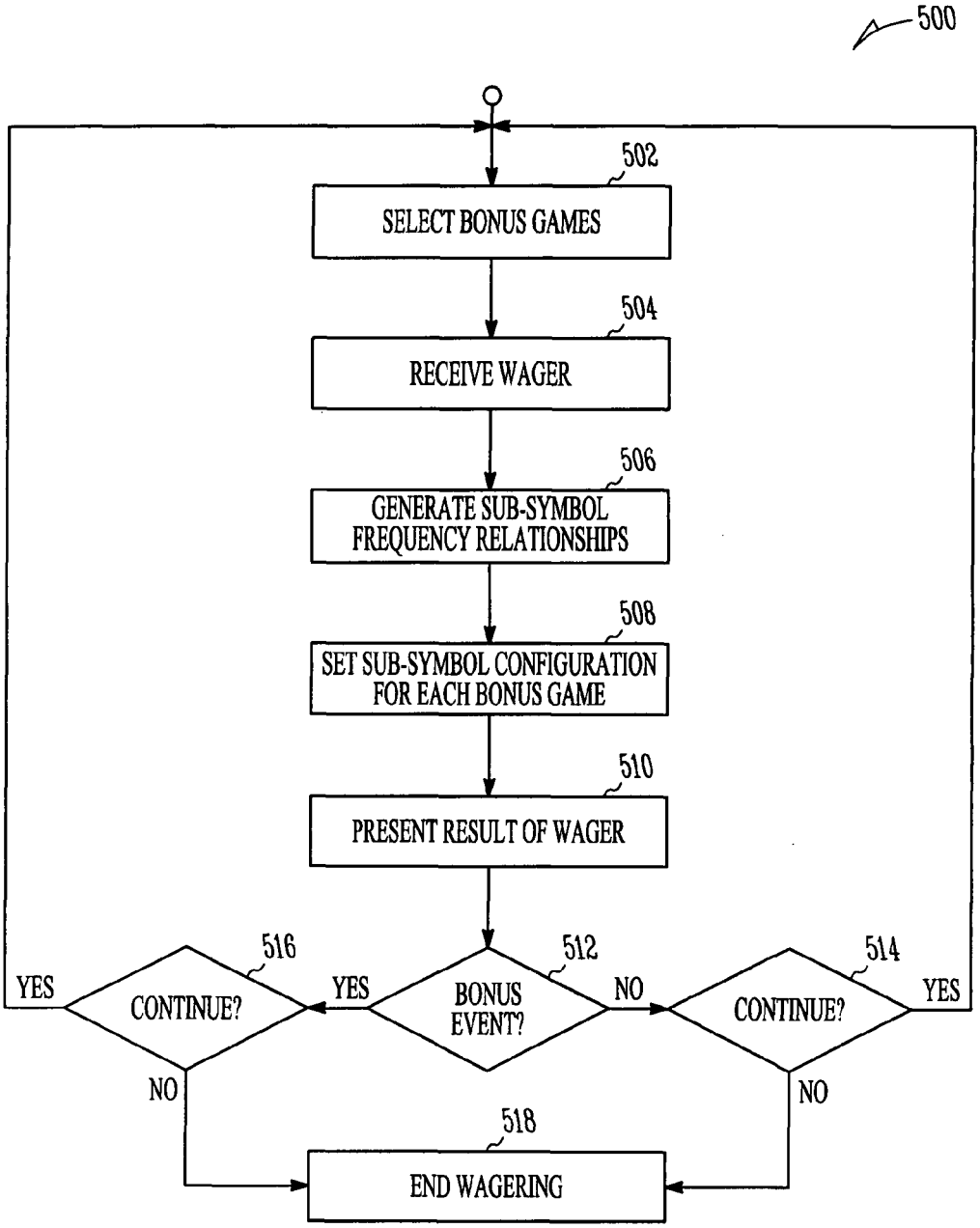
FIG. 5 is a flowchart illustrating a method for operating a wagering game machine according to embodiments of the invention.

FIG. 5 is a flowchart illustrating a method 500 for configuring a wagering game machine according to embodiments of the invention. The method begins at block 502 by selecting bonus games to be played upon the triggering of a bonus event. The games can be selected by the player, the wagering game operator, or both. In one embodiment, the bonus games that can be played are automatically selected by the wagering game operator using a computer program.

At block 504 a wager is received indicating that a base wagering game is to begin. The signal is sent to the bonus game modules to retrieve the selected bonus games. The bonus game modules may be located in a wagering game machine, a network server, or a memory location associated with a database in a casino. In one embodiment, the bonus game modules are located outside the casino operatively coupled to a network. In another embodiment, the bonus games are located in a single bonus game module.

At block 506 the dynamic calculation module generates associations of sub-symbols corresponding to bonus game payout frequencies and stores the result in a memory. The memory can be located in the wagering game machine, a network server, or a memory location associated with a database. The arrangement of sub-symbols can be formed to scatter trigger or to line trigger a bonus game.

At block 508 sub-symbol associations are received by the base wagering game module for each game selected. In one embodiment, the sub-symbol associations received by the base wagering game module include associations based on weighted values.

At block 510 the result of the wager is presented to the player on a display associated with the wagering game machine.

At block 512 a bonus event may scatter trigger or line trigger a specified bonus game, depending on the sub-symbol associations presented on the display. At block 512, the player is permitted to play a bonus game if a bonus game is triggered by the sub-symbol arrangement, otherwise the player is not allowed access to a bonus game. In one embodiment, the bonus game can be a free game. In another embodiment, the bonus game may permit an additional wager to be entered.

At blocks 514 and 516 the player is provided the option to continue or to discontinue wagering. At blocks 514 and 516 the player choosing to continue is returned to block 502, where the player can add to the existing bonus games or remove one or more existing bonus games. If the player elects to add or subtract a bonus games at block 502 new sub-symbol associations can be generated at block 506 and stored in the memory.

At block 518 any remaining value is returned to the player at the point the player discontinues wagering.

Figure 6:
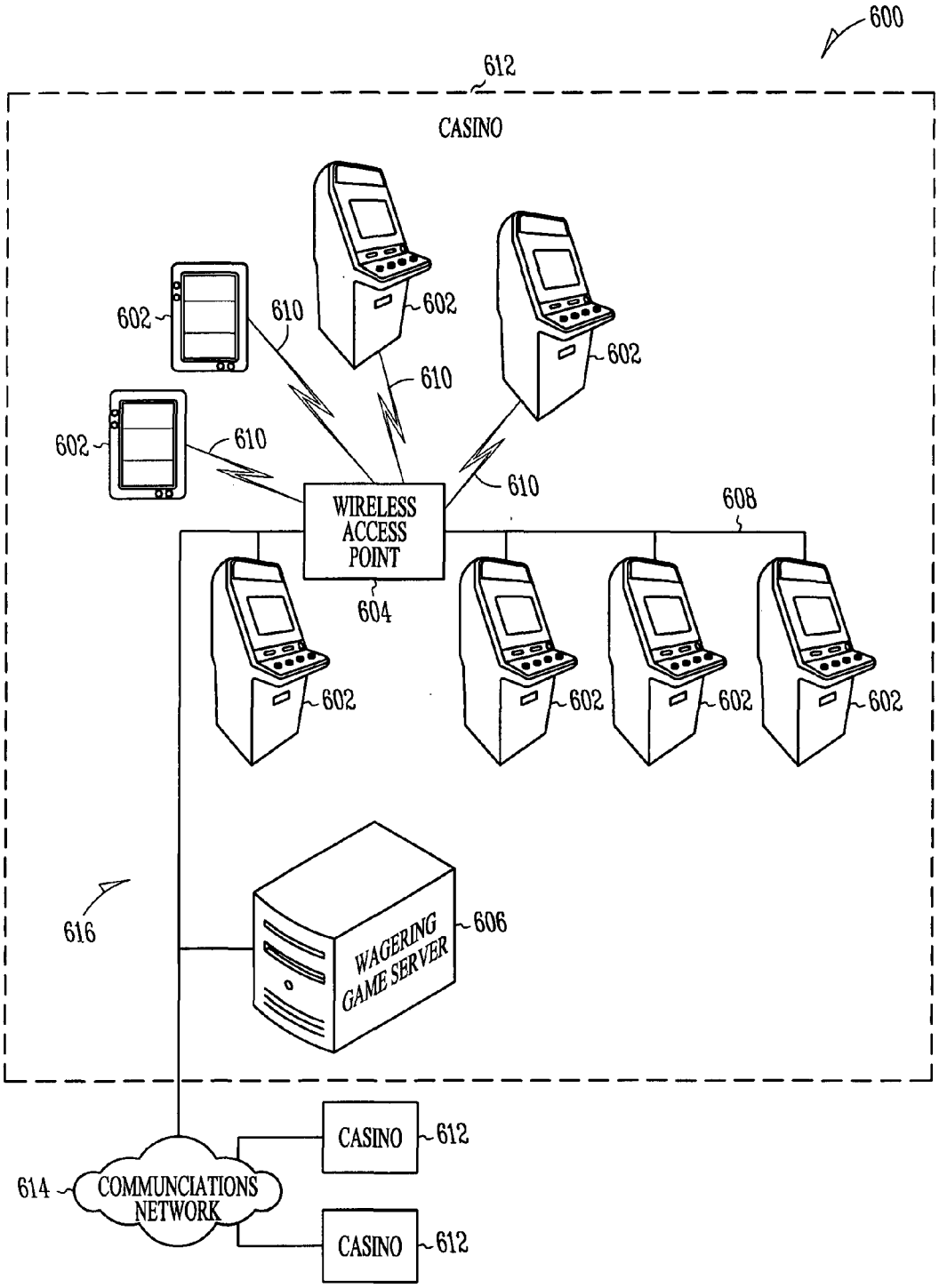
FIG. 6 is a block diagram illustrating a wagering game network, according to example embodiments of the invention.

While FIGS. 1, 2 and 3 describe example embodiments of a wagering game machine architecture, FIG. 6 shows how a plurality of wagering game machines can be connected in a wagering game network.

Example Wagering Game Network

FIG. 6 is a block diagram illustrating a wagering game network, according to example embodiments of the invention. As shown in FIG. 6, the wagering game network 600 includes a plurality of casinos 612 connected to a communications network 614.

Each of the plurality of casinos 612 includes a local area network 616, which includes a wireless access point 604, wagering game machines 602, and a wagering game server 606 that can serve wagering games over the local area network 616. As such, the local area network 616 includes wireless communication links 610 and wired communication links 608. The wired and wireless communication links can employ any suitable connection technology, such as Bluetooth, 802.11, Ethernet, public switched telephone networks, SONET, etc. In one embodiment, the wagering game server 606 can serve wagering games and/or distribute content to devices located in other casinos 612 or at other locations on the communications network 614.

The wagering game machines 602 and wagering game server 606 can include hardware and machine-readable media including instructions for performing the operations described herein. The wagering game network 600 can include the dynamic calculation module (shown as 134 and 135 of FIG. 1) operable as discussed. In some embodiments, the wagering game server 606 includes a dynamic calculation module 134/135. In one embodiment, the wagering game server 606 is located outside the casino 612 and communicatively coupled to the communications network 614 or the wireless access point 604.

The wagering game machines 602 described herein can take any suitable form, such as floor standing models, handheld mobile units, bartop models, workstation-type console models, etc. Further, the wagering game machines 602 can be primarily dedicated for use in conducting wagering games, or can include non-dedicated devices, such as mobile phones, personal digital assistants, personal computers, etc. In one embodiment, the wagering game network 600 can include other network devices, such as accounting servers, wide area progressive servers, player tracking servers, and/or other devices suitable for use in connection with embodiments of the invention.

Example Wireless Environment

In some embodiments, the wireless access point 604 and wagering game machines 602 can communicate orthogonal frequency division multiplexed (OFDM) communication signals over a multicarrier communication channel. The multicarrier communication channel can be within a predetermined frequency spectrum and can comprise a plurality of orthogonal subcarriers. In some embodiments, the multicarrier signals can be defined by closely spaced OFDM subcarriers. Each subcarrier can have a null at substantially a center frequency of the other subcarriers and/or each subcarrier can have an integer number of cycles within a symbol period. In some embodiments, the wireless access point 604 and wagering game machines 602 can communicate in accordance with a broadband multiple access technique, such as orthogonal frequency division multiple access (OFDMA). In some embodiments, the wireless access point 604 and wagering game machines 602 can communicate using spread-spectrum signals.

In some embodiments, the wireless access point 604 can be part of a communication station, such as wireless local area network (WLAN) communication station including a Wireless Fidelity (WiFi) communication station, or a WLAN access point (AP). In these embodiments, the wagering game machines 602 can be part of a mobile station, such as WLAN mobile station or a WiFi mobile station.

In some other embodiments, the wireless access point 604 can be part of a broadband wireless access (BWA) network communication station, such as a Worldwide Interoperability for Microwave Access (WiMax) communication station, as the wireless access point 604 can be part of almost any wireless communication device. In these embodiments, the wagering game machines 602 can be part of a BWA network communication station, such as a WiMax communication station.

In some embodiments, any of the wagering game machines 602 can part of a portable wireless communication device, such as a personal digital assistant (PDA), a laptop or portable computer with wireless communication capability, a web tablet, a wireless telephone, a wireless headset, a pager, an instant messaging device, a digital camera, a television, a medical device (e.g., a heart rate monitor, a blood pressure monitor, etc.), or other device that can receive and/or transmit information wirelessly.

In some embodiments, the wireless access point 604 and the wagering game machines 602 can communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they can also be suitable to transmit and/or receive communications in accordance with other techniques and standards. In some BWA network embodiments, the wireless access point 604 and the wagering game machines 602 can communicate RF signals in accordance with the IEEE 802.16-2004 and the IEEE 802.16(e) standards for wireless metropolitan area networks (WMANs) including variations and evolutions thereof. However, they can also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," Can 6005 and related amendments/versions.

In some embodiments, the wireless access point 604 and the wagering game machines 602 can communicate in accordance with standards such as the Pan-European mobile system standard referred to as the Global System for Mobile Communications (GSM). In some embodiments, the wireless access point 604 and the wagering game machines 602 can also communicate in accordance with packet radio services such as the General Packet Radio Service (GPRS) packet data communication service. In some embodiments, the wireless access point 604 and the wagering game machines 602 can communicate in accordance with the Universal Mobile Telephone System (UMTS) for the next generation of GSM, which can, for example, implement communication techniques in accordance with 2.5G and third generation (3G) wireless standards (See 3GPP Technical Specification, Version 3.2.0, March 2000). In some of these embodiments, the wireless access point 604 and the wagering game machines 602 can provide packet data services (PDS) utilizing packet data protocols (PDP). In other embodiments, the wireless access point 604 and the wagering game machines 602 can communicate in accordance with other standards or other air-interfaces including interfaces compatible with the enhanced data for GSM evolution (EDGE) standards (see 3GPP Technical Specification, Version 3.2.0, March 2000).

In other embodiments, the wireless access point 604 and the wagering game machines 602 can communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, the wireless access point 604 and the wagering game machines 602 can communicate in accordance with an ultra-wideband (UWB) communication technique where a carrier frequency is not used. In other embodiments, the wireless access point 604 and the wagering game machines 602 can communicate in accordance with an analog communication technique. In other embodiments, the wireless access point 604 and the wagering game machines 602 can communicate in accordance with an optical communication technique, such as the Infrared Data Association (IrDA) standard. In some embodiments, the wireless access point 604 and the wagering game machines 602 can communicate in accordance with the Home-RF standard which can be in accordance with a Home-RF Working Group (HRFWG) standard.

Example Wagering Game Machine

Figure 7:
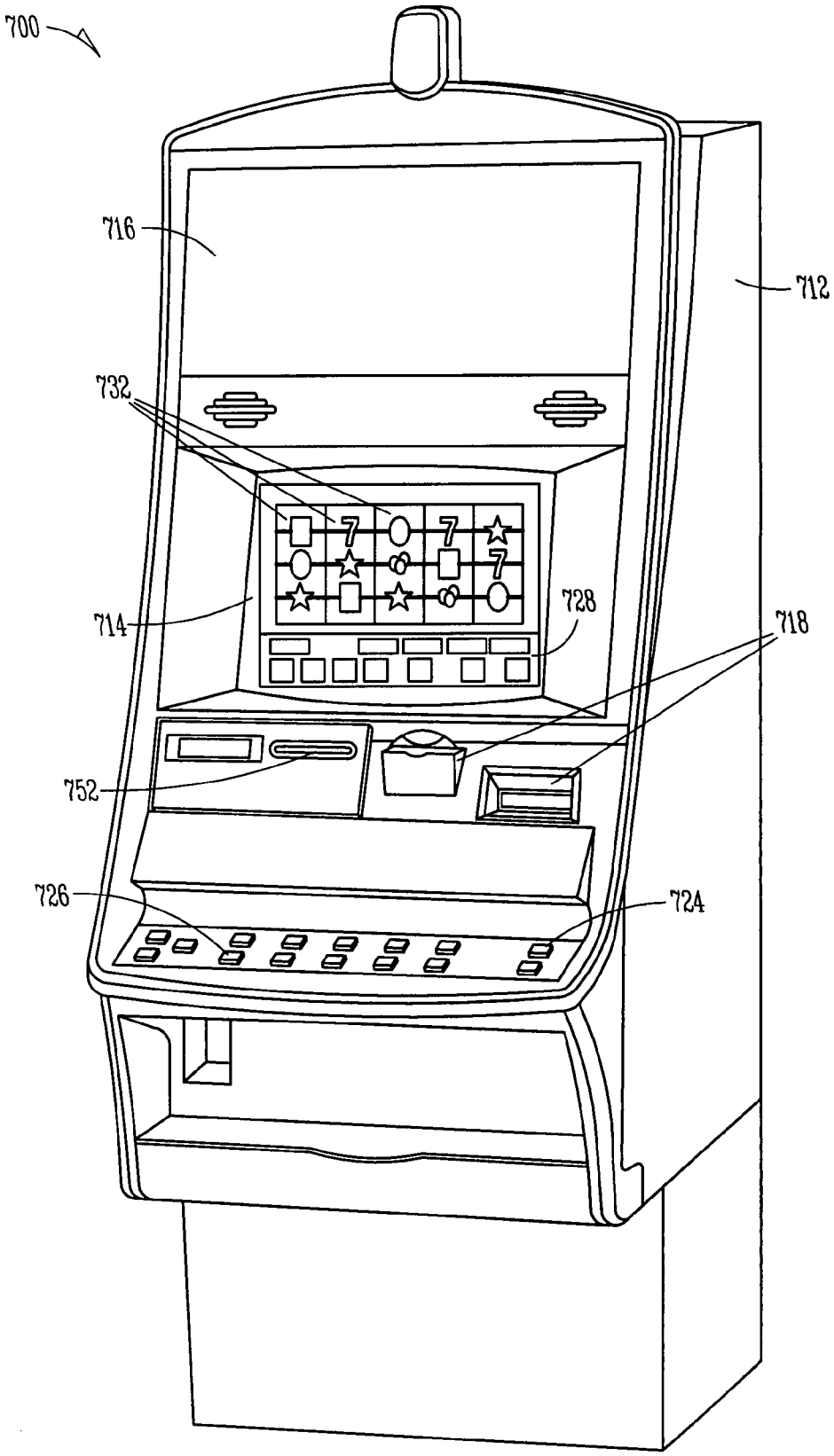
FIG. 7 is a perspective view of a wagering game machine, according to example embodiments of the invention.

FIG. 7 is a perspective view of a wagering game machine, according to example embodiments of the invention. Referring to FIG. 7, a wagering game machine 700 is used in gaming establishments, such as casinos. According to embodiments, the wagering game machine 700 can be any type of wagering game machine and can have varying structures and methods of operation. For example, the wagering game machine 700 can be an electromechanical wagering game machine configured to play mechanical slots, or it can be an electronic wagering game machine configured to play video casino games, such as blackjack, slots, keno, poker, blackjack, roulette, or video role playing games with wagering content, etc.

The wagering game machine 700 comprises a housing 712 and includes input devices, including value input devices 718 and a player input device 724. For output, the wagering game machine 700 includes a primary display 714 for displaying information about a basic wagering game. The primary display 714 can also display information about a bonus wagering game and a progressive wagering game. The wagering game machine 700 also includes a secondary display 716 for displaying wagering game events, wagering game outcomes, and/or signage information. While some components of the wagering game machine 700 are described herein, numerous other elements can exist and can be used in any number or combination to create varying forms of the wagering game machine 700.

The value input devices 718 can take any suitable form and can be located on the front of the housing 712. The value input devices 718 can receive currency and/or credits inserted by a player. The value input devices 718 can include coin acceptors for receiving coin currency and bill acceptors for receiving paper currency. Furthermore, the value input devices 718 can include ticket readers or barcode scanners for reading information stored on vouchers, cards, or other tangible portable storage devices. The vouchers or cards can authorize access to central accounts, which can transfer money to the wagering game machine 700.

The player input device 724 comprises a plurality of push buttons on a button panel 726 for operating the wagering game machine 700. In addition, or alternatively, the player input device 724 can comprise a touch screen 728 mounted over the primary display 714 and/or secondary display 716.

The various components of the wagering game machine 700 can be connected directly to, or contained within, the housing 712. Alternatively, some of the wagering game machine's components can be located outside of the housing 712, while being communicatively coupled with the wagering game machine 700 using any suitable wired or wireless communication technology.

The operation of the basic wagering game can be displayed to the player on the primary display 714. The primary display 714 can also display a bonus game associated with the basic wagering game. The primary display 714 can include a cathode ray tube (CRT), a high resolution liquid crystal display (LCD), a plasma display, light emitting diodes (LEDs), or any other type of display suitable for use in the wagering game machine 700. Alternatively, the primary display 714 can include a number of mechanical reels to display the outcome. In FIG. 7, the wagering game machine 700 is an "upright" version in which the primary display 714 is oriented vertically relative to the player. Alternatively, the wagering game machine can be a "slant-top" version in which the primary display 714 is slanted at about a thirty-degree angle toward the player of the wagering game machine 700. In yet another embodiment, the wagering game machine 700 can exhibit any suitable form factor, such as a free standing model, bartop model, mobile handheld model, or workstation console model.

A player begins playing a basic wagering game by making a wager via the value input device 718. The player can initiate play by using the player input device's buttons or touch screen 728. The basic game can include arranging a plurality of symbols along a payline 732, which indicates one or more outcomes of the basic game. Such outcomes can be randomly selected in response to player input. At least one of the outcomes, which can include any variation or combination of symbols, can trigger a bonus game.

In some embodiments, the wagering game machine 700 can also include an information reader 752, which can include a card reader, ticket reader, bar code scanner, RFID transceiver, or computer readable storage medium interface. In some embodiments, the information reader 752 can be used to award complimentary services, restore game assets, track player habits, etc.

Example Wagering Game Machine

Figure 8:
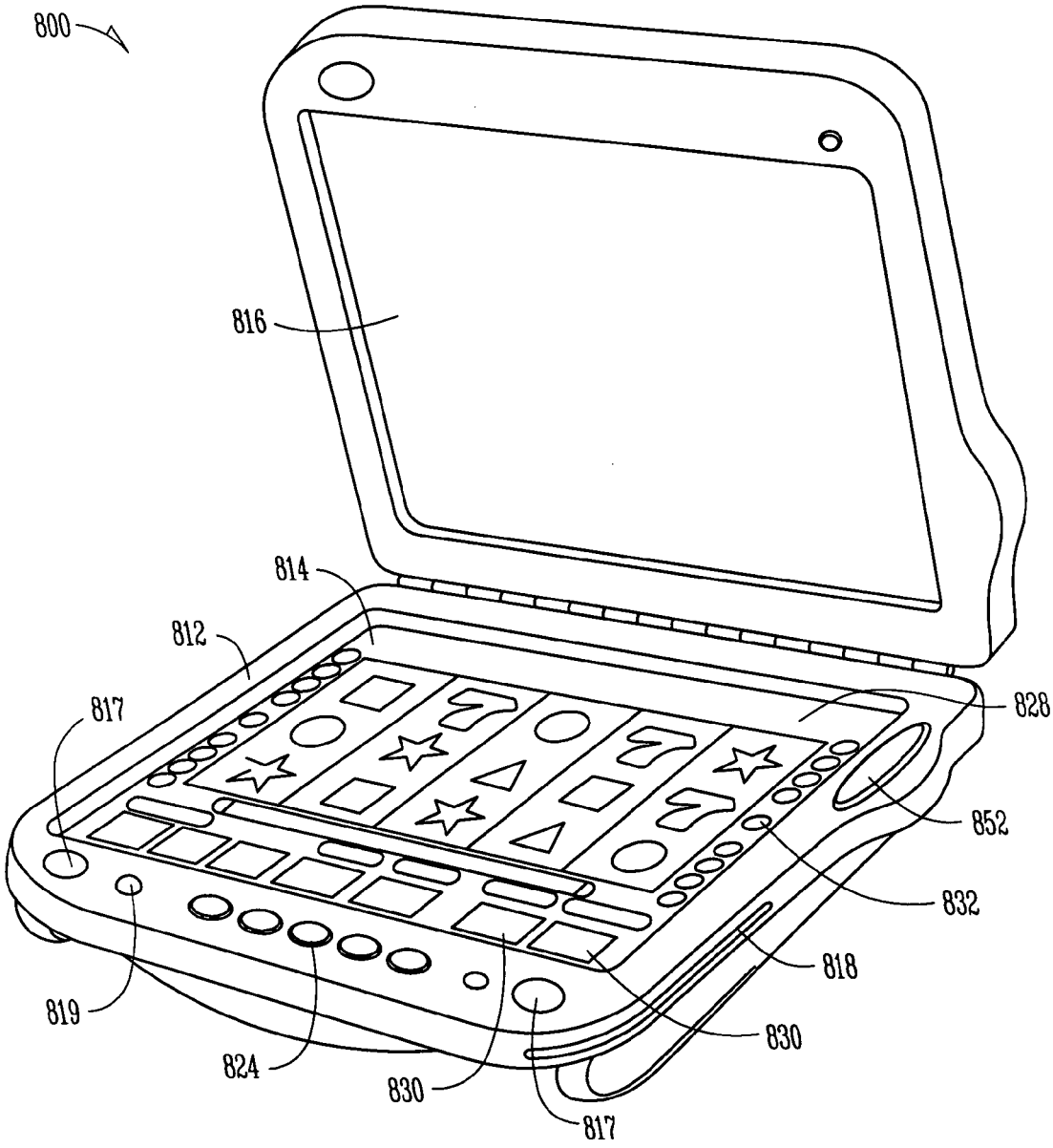
FIG. 8 shows an example embodiment of a wagering game machine.

FIG. 8 shows an example embodiment of a wagering game machine 810. Like free standing wagering game machines, in a handheld or mobile form, the wagering game machine 810 can include any suitable electronic device configured to play a video casino games such as blackjack, slots, keno, poker, blackjack, roulette, and video role playing games with wagering content. The wagering game machine 810 comprises a housing 812 and includes input devices, including a value input device 818 and a player input device 824. For output, the wagering game machine 810 includes a primary display 814, a secondary display 816, one or more speakers 817, one or more player-accessible ports 819 (e.g., an audio output jack for headphones, a video headset jack, etc.), and other conventional I/O devices and ports, which may or may not be player-accessible. In the embodiment depicted in FIG. 4, the wagering game machine 810 comprises a secondary display 816 that is rotatable relative to the primary display 814. The optional secondary display 816 can be fixed, movable, and/or detachable/attachable relative to the primary display 814. Either the primary display 814 and/or secondary display 816 can be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

The player-accessible value input device 818 can comprise, for example, a slot located on the front, side, or top of the casing 812 configured to receive credit from a stored-value card (e.g., casino card, smart card, debit card, credit card, etc.) inserted by a player. The player-accessible value input device 818 can also comprise a sensor (e.g., an RF sensor) configured to sense a signal (e.g., an RF signal) output by a transmitter (e.g., an RF transmitter) carried by a player. The player-accessible value input device 818 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 810.

Still other player-accessible value input devices 818 can use touch keys 830 on the touch-screen display (e.g., primary display 814 and/or secondary display 816) or player input devices 824. Upon entry of player identification information and, preferably, secondary authorization information (e.g., a password, PIN number, stored value card number, predefined key sequences, etc.), the player can be permitted to access a player's account. As one potential optional security feature, the wagering game machine 810 can be configured to permit a player to only access an account the player has specifically set up for the wagering game machine 810. Other conventional security features can also be utilized to, for example, prevent unauthorized access to a player's account, to minimize an impact of any unauthorized access to a player's account, or to prevent unauthorized access to any personal information or funds temporarily stored on the wagering game machine 810.

The player-accessible value input device 818 can itself comprise or utilize a biometric player information reader which permits the player to access available funds on a player's account, either alone or in combination with another of the aforementioned player-accessible value input devices 818. In an embodiment wherein the player-accessible value input device 818 comprises a biometric player information reader, transactions such as an input of value to the wagering game machine 810, a transfer of value from one player account or source to an account associated with the wagering game machine 810, or the execution of another transaction, for example, could all be authorized by a biometric reading, which could comprise a plurality of biometric readings, from the biometric device.

Alternatively, to enhance security, a transaction can be optionally enabled only by a two-step process in which a secondary source confirms the identity indicated by a primary source. For example, a player-accessible value input device 818 comprising a biometric player information reader can require a confirmatory entry from another biometric player information reader 852, or from another source, such as a credit card, debit card, player ID card, fob key, PIN number, password, hotel room key, etc. Thus, a transaction can be enabled by, for example, a combination of the personal identification input (e.g., biometric input) with a secret PIN number, or a combination of a biometric input with a fob input, or a combination of a fob input with a PIN number, or a combination of a credit card input with a biometric input. Any two independent sources of identity, one of which is secure or personal to the player (e.g., biometric readings, PIN number, password, etc.) could be utilized to provide enhanced security prior to the electronic transfer of any funds. In another embodiment, the value input device 818 can be provided remotely from the wagering game machine 810.

The player input device 824 comprises a plurality of push buttons on a button panel for operating the wagering game machine 810. In addition, or alternatively, the player input device 824 can comprise a touch screen mounted to a primary display 814 and/or secondary display 816. In one embodiment, the touch screen is matched to a display screen having one or more selectable touch keys 830 selectable by a user's touching of the associated area of the screen using a finger or a tool, such as a stylus pointer. A player enables a desired function either by touching the touch screen at an appropriate touch key 830 or by pressing an appropriate push button on the button panel. The touch keys 830 can be used to implement the same functions as push buttons. Alternatively, the push buttons 826 can provide inputs for one feature of the operating the game, while the touch keys 830 can allow for input needed for another feature of the game. The various components of the wagering game machine 810 can be connected directly to, or contained within, the casing 812, as seen in FIG. 4, or can be located outside the casing 812 and connected to the casing 812 via a variety of wired (tethered) or wireless connection methods. Thus, the wagering game machine 810 can comprise a single unit or a plurality of interconnected (e.g., wireless connections) parts which can be arranged to suit a player's preferences.

The operation of the basic wagering game on the wagering game machine 810 is displayed to the player on the primary display 814. The primary display 814 can also display the bonus game associated with the basic wagering game. The primary display 814 preferably takes the form of a high resolution LCD, a plasma display, an LED, or any other type of display suitable for use in the wagering game machine 810. The size of the primary display 814 can vary from, for example, about a 2-3" display to a 15" or 17" display. In at least some embodiments, the primary display 814 is a 7"-10" display. In one embodiment, the size of the primary display can be increased. Optionally, coatings or removable films or sheets can be applied to the display to provide desired characteristics (e.g., anti-scratch, anti-glare, bacterially-resistant and anti-microbial films, etc.). In at least some embodiments, the primary display 814 and/or secondary display 816 can have a 16:9 aspect ratio or other aspect ratio (e.g., 4:3). The primary display 814 and/or secondary display 816 can also each have different resolutions, different color schemes, and different aspect ratios.

As with the free standing embodiments a wagering gaming machine, a player begins play of the basic wagering game on the wagering game machine 810 by making a wager (e.g., via the value input device 818 or an assignment of credits stored on the handheld gaming machine via the touch screen keys 830, player input device 824, or buttons 826) on the wagering game machine 810. In some embodiments, the basic game can comprise a plurality of symbols arranged in an array, and includes at least one payline 832 that indicates one or more outcomes of the basic game. Such outcomes can be randomly selected in response to the wagering input by the player. At least one of the plurality of randomly selected outcomes can be a start-bonus outcome, which can include any variations of symbols or symbol combinations triggering a bonus game.

In some embodiments, the player-accessible value input device 818 of the wagering game machine 810 can double as a player information reader 852 that allows for identification of a player by reading a card with information indicating the player's identity (e.g., reading a player's credit card, player ID card, smart card, etc.). The player information reader 852 can alternatively or also comprise a bar code scanner, RFID transceiver or computer readable storage medium interface. In one embodiment, the player information reader 852 comprises a biometric sensing device.

General

In the above detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes can be made to the example embodiments described herein. The various embodiments are not necessarily mutually exclusive, as some embodiments can be combined with one or more embodiments to form new embodiments. Features or limitations of various embodiments described herein do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter.

What is claimed is:

1. A gaming system configured to conduct a wagering game including a base game and a selected bonus game, the base game including a base game outcome of symbols randomly generated from a plurality of symbols, the system comprising:

a. one or more input devices;

b. at least one display device;

c. one or more processors;

d. at least one memory device storing instructions that, when executed by the one or more processors, cause the one or more processors to operate with the one or more input devices and the at least one display device to:

i. receive an input indicative of a selection of a bonus game from a plurality of different bonus games, the selected bonus game being different from a prior selected bonus game;

ii. receive bonus game data associated with the selected bonus game, wherein the received bonus game data associated with the selected bonus game is specific to the selected bonus game;

iii. in response to receiving the bonus game data, generate at least one relationship between one or more sub-symbols and one or more symbols of the plurality of symbols such that the one or more sub-symbols are displayed with the one or more symbols according to the generated at least one relationship, the generated at least one relationship based on one or more probabilities of events occurring in the bonus game, and the one or more probabilities being included within the received bonus game data, wherein the probabilities of events occurring in the bonus game are specific to the selected bonus game;

iv. configure the base game to display the one or more sub-symbols with the one or more symbols according to the generated at least one relationship; and v. in response to a wager initiating play of the base game, randomly generate the base game outcome and display the outcome to a player; and vi. in response to at least one of the sub-symbols being displayed in the base game outcome, trigger the selected bonus game.

2. The gaming system of claim 1, wherein the selected bonus game is selected by the player.

3. The gaming system of claim 1, wherein the selected bonus game is selected by a human operator.

4. The gaming system of claim 1, wherein the plurality of different bonus games is displayed to a player prior to play of the base game.

5. The gaming system of claim 1, wherein at least two bonus games of the plurality of different bonus games have different bonus game expected values, and wherein the generated at least one relationship based on bonus game data from one of the at least two bonus games is different from the generated at least one relationship based on bonus game data from the other of the at least two bonus games as a result of the different bonus game expected values.

6. The gaming system of claim 1, further comprising:

a base game module providing base game data for generating outcomes of the base game;

a bonus game module providing the bonus game data of the selected bonus game;

a dynamic calculation module including relationship instructions for generating the at least one relationship between the one or more sub-symbols and the one or more symbols;

wherein the base game module, the bonus game module, and the dynamic calculation module, are connected for communication to the one or more processors and the at least one memory device; and wherein the one or processors generate the at least one relationship by executing the relationship instructions of the dynamic calculation module.

7. The gaining system of claim 6, wherein the base game module, the bonus game module, and dynamic calculation module reside on one or more servers on a communications network.

8. The gaming system of claim 1, wherein the generated at least one relationship is a mathematical relationship that produces a desired frequency of triggering the bonus game during play of the base game.

9. The gaming system of claim 1, wherein a new at least one relationship is generated each time the base game is played.

10. The gaming system of claim 1, wherein each symbol of the plurality of symbols has a respective predetermined probability of occurring in the base game outcome.

11. The gaming system of claim 1, wherein generating at least one relationship includes generating weighting factors for the one or more sub-symbols that cause the one or more sub-symbols to be displayed more often or less often in the base game outcome than the one or more symbols.

12. The gaming system of claim 1, wherein the received bonus game data includes at least one of bonus game payout frequencies, a bonus game payout value, and a bonus game expected value.

13. The gaming system of claim 1, wherein the at least one of the sub-symbols is a combination of sub-symbols that triggers the selected bonus game when displayed scattered in the base game outcome.

14. The gaming system of claim 1, wherein the at least one of the sub-symbols is a combination of sub-symbols that triggers the selected bonus game when displayed on a payline in the bonus game.

15. The gaming system of claim 1, wherein the instructions cause the one or more processors to select which of the at least one of the sub-symbols that trigger the selected bonus game.

16. A computer-implemented method of integrating a base game with one or more bonus games, the base game including a base game outcome of symbols randomly generated from a plurality of symbols, the method comprising:

receiving, via at least one of one or more input devices, an input indicative of a selection of a bonus game from a plurality of different bonus games, the selected bonus game being different from a prior selected bonus game;

receiving, via at least one of the one or more input devices, bonus game data associated with the selected bonus game, wherein the received bonus game data associated with the selected bonus game is specific to the selected bonus game;

in response to receiving the bonus game data, generating, via at least one of one or more processors, relationships between one or more sub-symbols and one or more symbols of the plurality of symbols such that the one or more sub-symbols are displayed with the one or more symbols according to the generated relationships, the generated relationships based on one or more probabilities of events occurring in the bonus game, and the one or more probabilities being included within the received bonus game data, wherein the probabilities of events occurring in the bonus game are specific to the selected bonus game;

configuring, via at least one of the one or more processors, the base game to display the one or more sub-symbols with the one or more symbols according to the generated relationship; and in response to a wager initiating play of the base game, randomly generating, via at least one of the one or more processors, the base game outcome and displaying the outcome to a player; and in response to at least one of the sub-symbols being displayed in the base game outcome, triggering, via at least one of the one or more processors, the selected bonus game.

17. The method of claim 16, wherein the selected bonus game is selected by the player.

18. The method of claim 16, wherein the selected bonus game is selected by a human operator.

19. The method of claim 16, wherein the plurality of different bonus games is provided for selection to a player of the base game.

20. The method of claim 16, wherein at least two bonus games of the plurality of different bonus games have different bonus game expected values, and wherein the generated at least one relationship based on bonus game data from one of the at least two bonus games is different from the generated at least one relationship based on bonus game data from the other of the at least two bonus games as a result of the different bonus game expected values.

21. The method of claim 16, wherein the generated relationships are mathematical relationships that produce a desired frequency of triggering the bonus game during play of the base game.

22. The method of claim 16, wherein generating relationships includes assigning the one or more sub-symbols to be displayed with the one or more symbols of the plurality of symbols each time the one or more symbols are displayed in the base game outcome.

23. The method of claim 22, wherein each symbol of the plurality of symbols has a respective predetermined probability of occurring in the base game outcome.

24. The method of claim 16, wherein generating relationships includes generating weighting factors for the one or more sub-symbols that cause the one or more sub-symbols to he displayed more often or less often in the base game outcome than the one or more symbols.

25. The method of claim 16, wherein the received bonus game data includes at least one of bonus game payout frequencies, a bonus game payout value, and a bonus game expected value.

26. The method of claim 16, wherein the at least one of the sub-symbols is a combination of sub-symbols that triggers the selected bonus game when displayed scattered in the base game outcome.

27. The method of claim 16, wherein the at least one of the sub-symbols is a combination of sub-symbols that triggers the selected bonus game when displayed on a payline in the bonus game.

28. The method of claim 16, further comprising selecting, via at least one of the one or more processors, which of the at least one of the sub-symbols trigger the selected bonus game.

29. A computer-readable, non-transitory medium storing executable instructions that, when executed by a gaming system operable to conduct a wagering game including a base game and a bonus game, the base game including a base game outcome of symbols randomly generated from a plurality of symbols, cause the gaming system to perform the method comprising:

receiving an input indicative of a selection of a bonus game from a plurality of different bonus games, the selected bonus game being different from a prior selected bonus game;

receiving bonus game data associated with the selected bonus game, wherein the received bonus game data associated with the selected bonus game is specific to the selected bonus game;

in response to receiving the bonus game data, generating at least one relationship between one or more sub-symbols and one or more symbols of the plurality of symbols such that the one or more sub-symbols are displayed with the one or more symbols according to the generated at least one relationship; the generated at least one relationship based on one or more probabilities of events occurring in the bonus game, and the one or more probabilities being included within the received bonus game data, wherein the probabilities of events occurring in the bonus game are specific to the selected bonus game;

configuring the base game to display the one or more sub-symbols with the one or more symbols according to the generated at least one relationship; and in response to a wager initiating play of the base game, randomly generating the base game outcome and displaying the outcome to a player; and in response to at least one of the sub-symbols being displayed in the base game outcome, triggering the selected bonus game.

30. The medium of claim 29, wherein the selected bonus game is selected by the player.

31. The medium of claim 29, wherein the selected bonus game is selected by a human operator.

32. The medium of claim 29, wherein the a plurality of different bonus games is provided for selection to a player of the base game.

33. The medium of claim 29, wherein at least two bonus games of the plurality of different bonus games have different bonus game expected values, and wherein the generated at least one relationship based on bonus game data from one of the at least two bonus games is different from the generated at least one relationship based on bonus game data from the other of the at least two bonus games.

34. The medium of claim 29, the executable instructions further comprising:

a base game module providing base game data for generating outcomes of the base game;

a bonus game module providing the bonus game data of the bonus game;

a dynamic calculation module including relationship instructions for generating the at least one relationship between the one or more sub-symbols and the one or more symbols; and wherein the gaming system executes the relationship instructions of the dynamic calculation module to generate the at least one relationship.

35. The medium of claim 34, wherein the base game module, the bonus game module, and dynamic calculation module reside on one or more servers on a communications network.

36. The medium of claim 29, wherein the generated at least one relationship is a mathematical relationship that produces a desired frequency of triggering the bonus game during play of the base game.

37. The medium of claim 29, wherein generating at least one relationship includes assigning the one or more sub-symbols to be displayed with the one or more symbols of the plurality of symbols each time the one or more symbols are displayed in the base game outcome.

38. The medium of claim 37, wherein each symbol of the plurality of symbols has a respective predetermined probability of occurring in the base game outcome.

39. The medium of claim 29, wherein generating at least one relationship includes generating weighting factors for the one or more sub-symbols that cause the one or more sub-symbols to be displayed more often or less often in the base game outcome than the one or more symbols.

40. The medium of claim 29, wherein the received bonus game data includes at least one of bonus game payout frequencies, a bonus game payout value, and a bonus game expected value.

41. The medium of claim 29, wherein the at least one of the sub-symbols is a combination of sub-symbols that triggers the selected bonus game when displayed scattered in the base game outcome.

42. The medium of claim 29, wherein the at least one of the sub-symbols is a combination of sub-symbols that triggers the selected bonus game when displayed on a payline in the bonus game.

43. The medium of claim 29, wherein the instructions cause the at least one of the processors to select which of the one or more sub-symbols trigger the selected bonus game.

44. A gaming system configured to conduct a wagering game including a base game and a selected bonus game, the base game including a base game outcome of symbols randomly generated from a plurality of symbols, the system comprising:

one or more input devices;

at least one display device;

one or more processors;

at least one memory device storing executable instructions that, when executed by the one or more processors, cause the one or more processors to operate with the one or more input devices and the at least one display device to:

receive an input indicative of a selection of one or more bonus games from a plurality of different bonus games, the selected one or more bonus games being different from a prior selected bonus game;

receive bonus game data associated with the one or more selected bonus games, the one or more selected bonus games being one or more of a first bonus game and a second bonus game, the first and second bonus game being different bonus games, the one or more selected bonus games being triggered by one or more sub-symbols being displayed in the base game outcome, wherein the received bonus game data associated with the one or more selected bonus games is specific to the respective selected bonus game;

in response to the one or more selected bonus games being the first bonus game, generate at least one first relationship between one or more first sub-symbols and one or more first symbols of the plurality of symbols such that the one or more first sub-symbols are displayed with the one or more first symbols according to the at least one first relationship, the at least one generated first relationship based on one or more first probabilities of events occurring in the first bonus game, the one or more first probabilities being included within the received bonus game data, wherein the one or more first probabilities of events occurring in the first bonus game are specific to the first bonus game;

in response to the one or more selected bonus games being the second bonus game, generate at least one second relationship between one or more second sub-symbols and one or more second symbols of the plurality of symbols such that the one or more second sub-symbols are displayed with the one or more second symbols in accordance with the at least one second relationship, the at least one generated second relationship based on one or more second probabilities of events occurring in the second bonus game, the second probabilities being different than the first probabilities and resulting in a different at least one generated second relationship than the at least one generated first relationship, the one or more second probabilities being included within the received bonus game data, wherein the one or more second probabilities of events occurring in the second bonus game are specific to the second bonus game;

configure the base game to display the one or more first sub-symbols with the one or more first symbols, or the one or more second sub-symbols with the one or more second symbols, according to the generated first or second relationship, respectively;

in response to a wager initiating play of the base game, randomly generate the base game outcome and display the outcome to a player; and in response to at least one of the first sub-symbols being displayed in the base game outcome when the base game is configured according to the first relationship, or at least one of the second sub-symbols being displayed in the base game outcome when the base game is configured according to the second relationship, trigger the selected bonus game.

45. The gaming system of claim 44, further comprising:

in response to the one or more selected bonus games being both the first and second bonus games, generate at least one first relationship between one or more first sub-symbols and one or more first symbols of the plurality, and at least one second relationship between one or more second sub-symbols and one or more second symbols of the plurality of symbols, such that the one or more first and second sub-symbols are displayed with the one or more first and second symbols according to the at least one first and second relationships, wherein the at least one generated first relationship is based on one or more first probabilities of events occurring in the first bonus game and the at least one generated second relationship is based on one or more second probabilities of events occurring in the second bonus game, the second probabilities being different than the first probabilities and resulting in a different at least one generated second relationship than the at least one generated first relationship, the one or more second probabilities being included within the received bonus game data; and configure the base game to display the one or more first sub-symbols with the one or more first symbols and the one or more second sub-symbols with the one or more second symbols according to the generated first and second relationships, respectively.

46. The gaming system of claim 44, wherein the first bonus game has a first bonus game expected value, the second bonus game has a second bonus game expected value, the second bonus game expected value is different from the first bonus game expected value, and, as a result of at least the different expected values, the at least one generated first relationship is different from the at least one generated first relationship.

47. The gaming system of claim 44, wherein the first sub-symbols and the second sub-symbols are different symbols.

48. The gaming system of claim 44, wherein the instructions further cause the one or more processors to select which of the at least one of the first sub-symbols trigger the first bonus game.

49. The gaming system of claim 44, wherein the instructions further cause the one or more processors to select which of the at least one of the second sub-symbols trigger the second bonus game.

* * * * *

UNITED STATES PATENT AND TRADEMARK OFFICE

CERTIFICATE OF CORRECTION

PATENT NO. : 8,678,907 B2
APPLICATION NO. : 12/513974
DATED : March 25, 2014
INVENTOR(S) : Larry Pacey It is certified that error appears in the above-identified patent and that said Letters Patent is hereby corrected as shown below:

In the Claims

On Column 16, Line 20 (Claim 7, Line 1), please replace the word "gaining" with "gaming."

On Column 16, Line 52 (Claim 15, Line 3), please remove the word "that" prior to "trigger."

On Column 18, Line 45 (Claim 32, Line 1), please delete the "a" prior to "plurality."

Signed and Sealed this
Fifteenth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,678,907 B2
APPLICATION NO. : 12/513974
DATED : March 25, 2014
INVENTOR(S) : Larry Pacey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 251 days.

Signed and Sealed this
Twenty-ninth Day of September, 2015

Michelle K. Lee

Michelle K. Lee
*Director of the United States Patent and Trademark Office*